US005996713A

United States Patent [19]

Pessier et al.

[11] Patent Number: 5,996,713

[45] **Date of Patent: *Dec. 7, 1999**

[54] ROLLING CUTTER BIT WITH IMPROVED ROTATIONAL STABILIZATION

[75] Inventors: Rudolf C. O. Pessier, Houston, Tex.; John V. Kenner, Balwyn, Australia; Matthew R. Isbell, Houston, Tex.; Mohammad Swadi, Corpus Christi, Tex.; Danny E. Scott, Montgomery, Tex.

[73] Assignee: Baker Hughes Incorporated, Houston, Tex.

[ * ] Notice: This patent is subject to a terminal disclaimer.

[21] Appl. No.: 08/926,730

[22] Filed: Sep. 10, 1997

Related U.S. Application Data

[63] Continuation-in-part of application No. 08/773,458, Dec. 24, 1996, abandoned, which is a continuation of application No. 08/378,345, Jan. 26, 1995, Pat. No. 5,586,612.

[51] Int. Cl.[6] ..... E21B 10/08

[52] U.S. Cl. ..... 175/353; 175/356; 175/376

[58] Field of Search ..... 175/353, 376, 175/350, 356, 398

[56] References Cited

U.S. PATENT DOCUMENTS

| | | | |
|---|---|---|---|
| 930,759 | 8/1909 | Hughes | 175/228 |
| 1,263,802 | 4/1918 | Reed | 175/340 |
| 1,635,592 | 7/1927 | Wadsworth | 175/353 X |
| 2,147,926 | 2/1939 | Scott | 175/353 |
| 2,148,372 | 2/1939 | Childers et al. | 175/353 X |
| 2,340,492 | 2/1944 | Scott | 175/353 |
| 2,463,932 | 3/1949 | Zublin | 175/353 |
| 3,628,616 | 12/1971 | Neilson . | |
| 3,696,876 | 10/1972 | Ott | 175/374 |
| 4,067,406 | 1/1978 | Garner et al. | 175/341 |
| 4,285,409 | 8/1981 | Allen | 175/336 |
| 4,657,093 | 4/1987 | Schumacher | 175/353 |
| 4,763,736 | 8/1988 | Varel, Sr. | 175/341 |
| 4,953,641 | 9/1990 | Pessier | 175/353 |
| 5,145,016 | 9/1992 | Estes . | |
| 5,147,000 | 9/1992 | Kaalstad . | |
| 5,178,222 | 1/1993 | Jones et al. . | |
| 5,494,123 | 2/1996 | Nguyen . | |

OTHER PUBLICATIONS

"Field Testing of Low–Friction–Gauge PDC Bits", SPE Drilling & Completion; Mar. 1993.

German Patent No. 1123 637, filed May 23, 1958, issued Feb. 15, 1962 no translation.

German Patent No. 1223779, filed Feb. 8, 1966, issued Sep. 1, 1966 no translation.

German patent, number unknown, date unknown, no translation, partial patent.

*Primary Examiner*—Frank Tsay

*Attorney, Agent, or Firm*—James E. Bradley

[57] ABSTRACT

A rock bit has a body and three cutters that include generally conical surfaces, at least one of which contains an outermost, circumferential row of heel teeth that dislodge cuttings from the borehole wall and bottom. The heel teeth form a corner with the borehole wall with successive contact points defined by the path of outer edges of the heel teeth while rotating into, and prescribing, the corner as it spirals downwardly during drilling. The rotational axis of the cutter is offset from the geometric centerline or intended rotational axis of the bit. Stabilizing pads extend outwardly from the body, each concluding in a surface that contains a low-friction, wear-resistant surface that engage the wall of the borehole. The center of each surface is located directly across from the contact point of an opposed cutter.

27 Claims, 3 Drawing Sheets

ROLLING CUTTER BIT WITH IMPROVED ROTATIONAL STABILIZATION

CROSS REFERENCE

This application is a continuation-in-part of application Ser. No. 08/773,458, filed Dec. 24, 1996, now abandoned, which is a continuation of application Ser. No. 08/378,345, filed Jan. 26, 1995, now U.S. Pat. No. 5,586,612.

BACKGROUND OF THE INVENTION

1. Field of the Invention

This invention relates to earth-boring bits of the type using rotatable cutters, especially those having wear pads that enhance rotational stability.

2. Background Information

The earth-boring bit having rotatable cutters or cones is commonly known as the rock bit, even though its use is not limited to those geological formations known as rock. The bit may experience rapid lateral displacements during drilling in an even slightly oversized borehole, a major cause of accelerated wear and catastrophic failure of the cutting elements, which often are called "teeth." Other causes of lateral displacement include doglegs, keyseats, and horizontal drilling, all of which can cause the bit to rotate about an axis other than its intended or designed rotational axis. These lateral displacements cause disruptions from desired rotation about the geometric centerline of the bit, or intended rotational axis. A particularly harmful form of lateral displacement results in reverse rotations or chaotic motions about the rotational axis of the bit called "backward whirl," which can damage the teeth, bearings, and seals. Backward whirl and similar dysfunctions tend to be unstable and worsen over time. In contrast, the teeth of a rotationally stable bit move in generally concentric circles about a stationary rotational axis with minimum slippage relative to the borehole bottom, which reduces wear and inhibits catastrophic failures.

Prior-art rock bits have stabilization pads to reduce lateral movements and create rotational stability. However, the stabilizing pads of these bits are positioned generally with the center of the pad aligned with the rotational axis of each cutter. While such pads are somewhat beneficial in rock bits having cones with positive offset with respect to the rotational axis of the bit, they are not placed sufficiently far from the region of contact between the cutters and the borehole wall to effectively counteract rotation about points of cutter contact on the periphery of the bit and thus effectively minimize or arrest lateral vibrations and backward whirl. Also, with the positioning of the conventional pads, lateral displacements are resisted with the pads being at a substantial angle to, instead of being aligned with, the wall contact forces.

SUMMARY OF THE INVENTION

The general object of the invention is to provide a rolling cone rock bit with improved stabilization pads that minimize lateral movements and rotation about cutter contact points on the periphery of the bit, especially backward whirl.

The above and other objects of the invention are achieved in a three-cone rock bit having a body and three cutters, each of which includes generally conical surfaces, at least one of which contains an outermost, circumferential row of heel teeth that dislodge cuttings from a borehole bottom. The heel teeth form a corner with the borehole wall with successive contact points or regions defined by the outer edges of the heel teeth while rotating into, and prescribing, the corner as it spirals downwardly during drilling. The rotational axis of each cutter is offset from the geometric centerline or intended rotational axis of the bit. Stabilizing pads extend outwardly from the body, concluding in low-friction, wear-resistant surfaces. These surfaces are diametrically across from the wall contact point of the opposed cutter. Preferably, the center of this surface is located directly across from the contact point and contains a wear resistant surface of hard material, such as sintered tungsten carbide, or a super-hard material, such as diamond. The best surfaces are those that are highly wear resistant and remain smooth as they wear down.

The above as well as additional objects, features, and advantages of the invention will become apparent in the following detailed description.

DETAILED DESCRIPTION OF THE INVENTION

Figure 1:
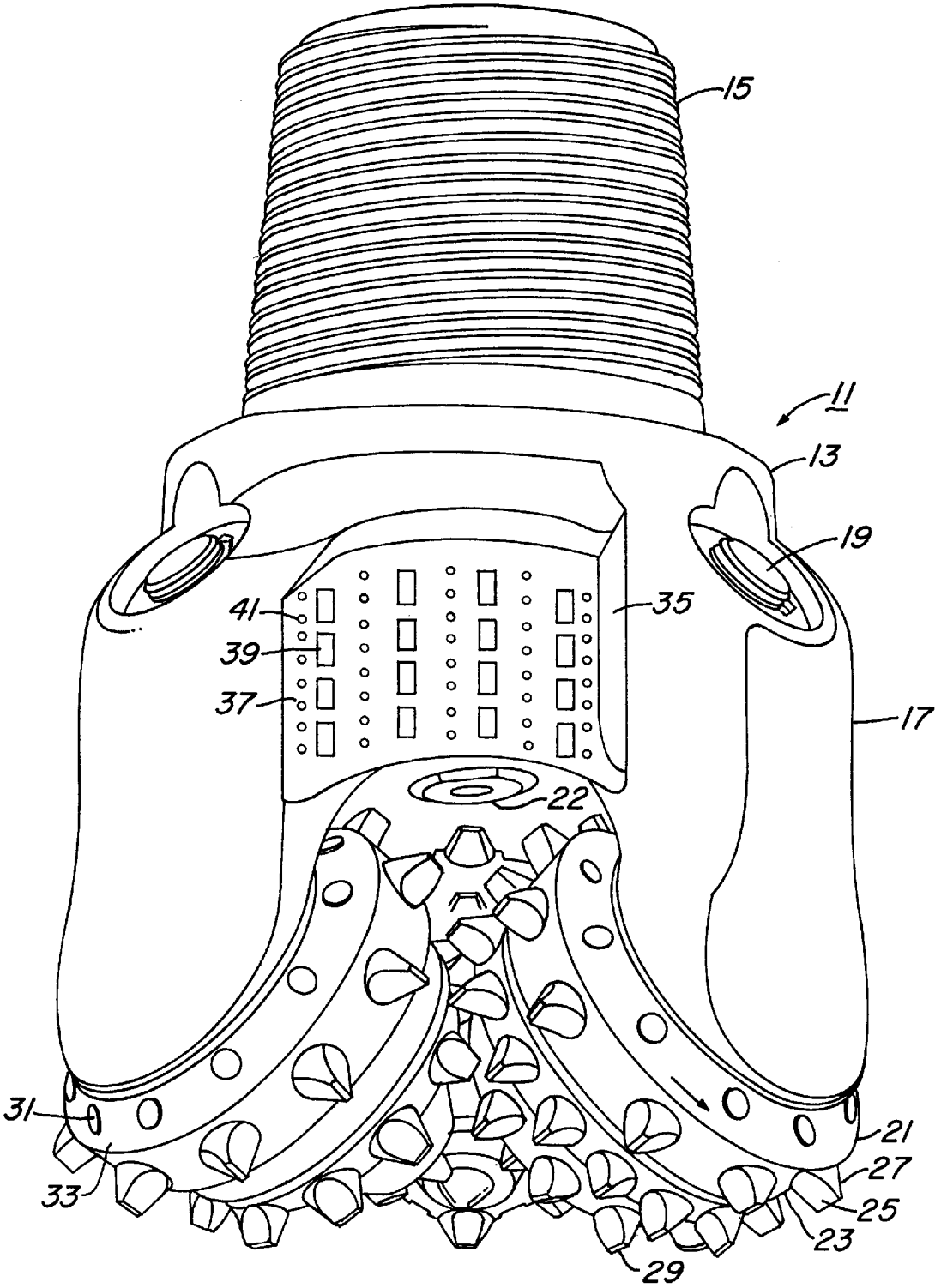
FIG. 1 is a perspective view of an earth-boring bit of the rolling cone or cutter type, showing an improved wear pad constructed according to the principles of the invention.

Referring initially to FIG. 1 of the drawings, the numeral 11 designates an earth-boring bit having a body 13, an upper end 15 of which is threaded for attachment to a drill string used to raise and lower the bit in a borehole and to rotate the bit during drilling. Body 13 includes a plurality of legs 17, preferably three, each of which includes a bearing shaft (not shown) and a lubrication system, the only part of which shown in FIG. 1 is a cap 19. Cap 19 secures components of the system that confine lubricant within bit 11 to reduce the friction in bearings located between rotatable cutters or cones 21 and their respective shafts. Bit 11 of FIG. 1 includes a plurality of nozzles 22 through which drilling fluid is pumped to impinge upon the borehole bottom to wash cuttings away from the bit and circulate them to the surface.

Each cutter 21 includes generally conical surfaces, one of which 23 contains a circumferential row of heel cutting elements or teeth 25 that dislodge cuttings from a borehole bottom and form a corner with the borehole wall. Heel teeth 25, and to a lesser extent cutters 21, have a series of successive contact points W with the sidewall of the borehole that may be seen in FIG. 2 (the points W may during drilling become regions or lines rather than a precise point). These points W are defined by the outer edges or surfaces 27 of successive heel teeth that rotate into and prescribe a corner between the borehole bottom and the borehole wall as the corner spirals downwardly and helically during drilling. There are additional, inner teeth 29 on each cutter and gage inserts 31 on an outermost conical surface 33 that is sometimes referred to as a "gage surface."

Bit body 13 and cutters 21 rotating on bearing shafts define a first or bit rotational axis 34 (see FIG. 2) about which the bit rotates during drilling. This rotational axis is the geometric center or centerline of the bit about which it is designed or intended to rotate. Each of the circumferential rows of cutter teeth, such as the heel teeth 25 and inner row teeth 29, will form concentric circles around this "first" rotational axis 34 of the bit if the bit is running "on center" (i.e., rotating precisely about the geometric centerline).

Each of the cutters rotate about a different rotational axis 36 ("the cutter axis"), which intersects the centerline or axis 34 of the bit if the bit is intended to be what is called "non-offset," a feature that is desirable in the harder earth formations. If the bit is intended to drill softer formations, more slippage of the teeth against the borehole bottom will increase the speed of drilling or drilling rate. One way to increase slippage is achieved with cone "offset," by which the rotational axis 36 of each cutter is offset from the centerline or axis 34 of the bit, as may be seen in FIG. 2. There is nearly always an offset in rolling cutter bits by choice of the rock bit designers for reasons not applicable to this invention.

In the bit of FIG. 1, a plurality of low-friction, wear-resistant stabilizing pads 35 extend radially from the body and have a surface 37 containing alternate regions of a first, hard material 39 and a second, super-hard material 41. As shown in FIG. 1, the hard material 39 and super-hard material 41 are discrete regions that are interspersed in the pad 35, the majority of which is formed of softer but still wear-resistant matrix material.

Sintered tungsten carbide is the preferred hard metal or material 39. However, cast or sintered components of chromium, molybdenum, niobium, tantalum, titanium, and vanadium carbides would be suitable. The super-hard material 41, which is formed flush with hard metal 39 and the metal matrix surface 37 of stabilizing pad 35, is a material of a class that includes natural diamond, synthetic or polycrystalline diamond, cubic boron nitride and similar materials having hardness in excess of 2800 on the Knoop hardness scale. Super-hard materials are to be distinguished from cemented carbide materials and other hard metals, and are the materials used to cut, grind, and shape hard metals and other similar materials. The preferred super-hard material is one of the diamond materials, preferably natural diamond.

The selection of the suitable wear pad materials and their densities as a percentage of the total pad surface is a function of the abrasiveness of the formations and the severity of the application, which can vary from the conventional straight hole to directional drilling in which the pads take on the additional task of controlling the side-cutting aggressiveness of a bit.

An alternative to the hard and super-hard material mixture and a particularly successful material is macrocrystalline tungsten carbide hardfacing, which consists of 70% tungsten carbide particles and 30% matrix. Although this material has no super-hard particles, it is successful due to its high tungsten carbide density. Another advantage is the "slick" low-friction nature of a pad which wears uniformly and does not develop a cutting edge or protrusions by selective wear of different elements in the pad.

Figure 3:
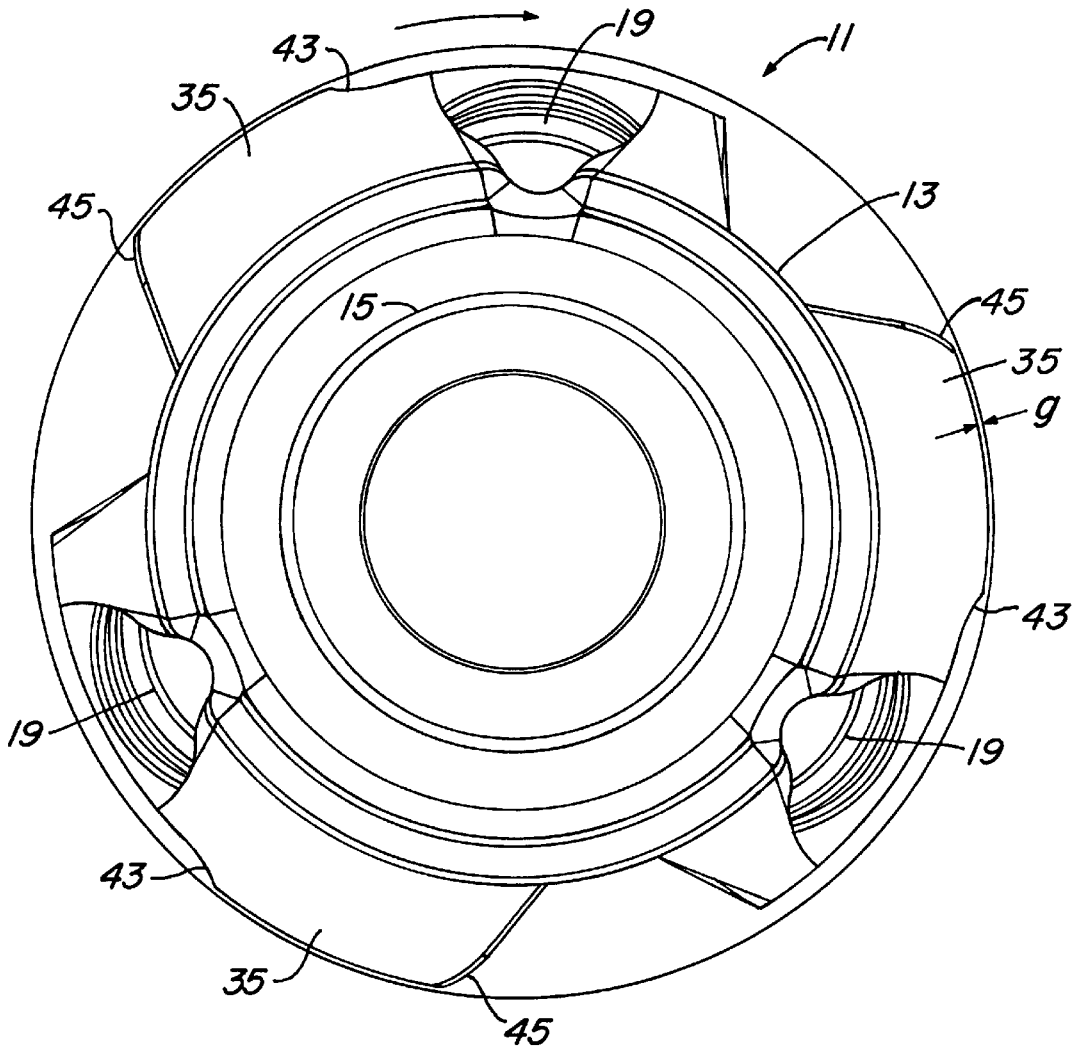
FIG. 3 is a perspective view of the FIG. 1 bit as seen from above with the cutters omitted to show the integral construction and shape of the wear pads.

Pads 35 are an integral part of the bit body as illustrated in FIG. 3 in which the cones have been omitted. An important requirement for the pads is their smooth configuration with a non-aggressive, non-cutting chamfer 43 on the leading side and a generous radius 45 on the trailing side, which allows them to smoothly roll into the borehole wall without cutting, causing damage or high torque spikes. In the preferred embodiment of pad the pad surfaces are to be ground smooth with a gap g between the pad and borehole wall in the range of 0 to 0.030 inches.

Figure 2:
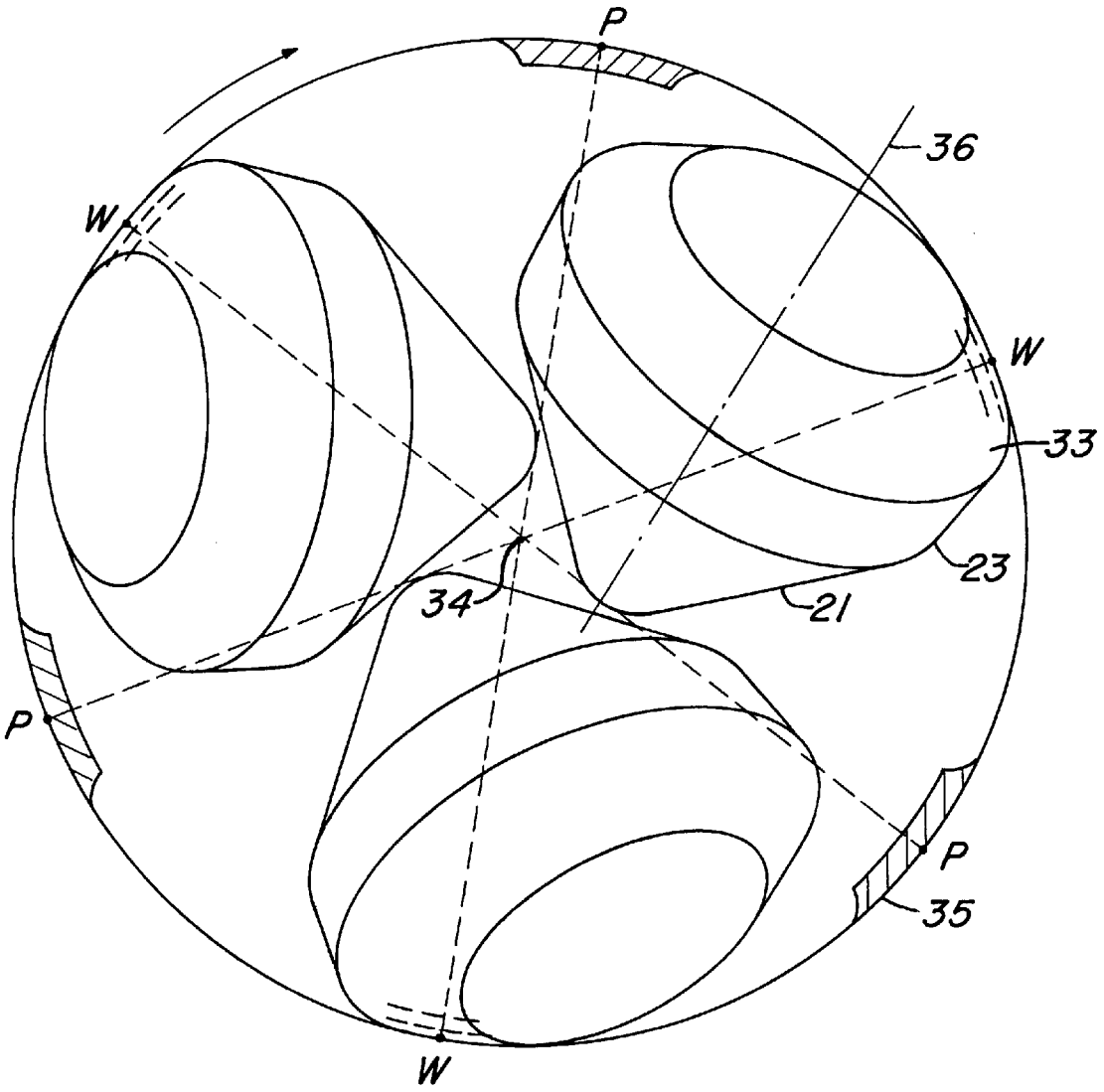
FIG. 2 is a schematic view as seen from above the cutters of the FIG. 1 bit to show the relationship between the cutters and the wear pads of the invention.

Each stabilizing pad 35, designated schematically in FIG. 2, is diametrically opposed to an area W, in which cutter teeth 25 engage and or contact borehole wall with their outer surfaces 27. This achieves a degree of stability that is not achieved if the pad is positioned at an angle substantially less than 180° from the borehole contact point or region. Because the position midway between adjacent contact areas W is optimal for resisting rotation and movements about W and direct lateral displacements across the center of the bit, the centerline of the pad should be as close as possible to the alignment shown in FIG. 2 and the area of the pad that engages and opposes the wall of the borehole should be sufficient to prevent entry of the pad into the wall of the hole. For the softer formations, the area of the pad should be larger than the pads used in the hard formation bits to limit contact stresses to levels less than the compressive strength of the formation.

A similar pad location in a two-cone bit is disclosed in commonly assigned U.S. Pat. No. 5,586,612 to Isbell et al., which is incorporated herein by reference.

It should be apparent from the foregoing that we have provided an invention having significant advantages. The improved stabilization pad suppresses lateral movements of the bit during drilling and the backward whirl that otherwise accelerates premature wear and deterioration. While we have shown our invention in only one of its forms, it is not thus limited but is susceptible to various changes and modifications without departing from the spirit thereof.

We claim:

1. An earth-boring bit comprising:

a bit body having an intended rotational axis;

at least one bearing shaft extending inwardly and downwardly from the bit body;

a plurality of cutters mounted for rotation on each bearing shaft, each cutter having a point or region of contact with the wall of the borehole being drilled; and a plurality of stabilizing surfaces on the body, each of the stabilizing surfaces containing a wear-resistant material that is smooth to engage the wall of the borehole without cutting, the stabilizing surfaces being above and across from the contact point or region of one of the cutters to confine the bit body to rotation about its rotational axis.

2. The earth-boring bit according to claim 1, whereas there are three of the cutters and three of the stabilizing surfaces.

3. The earth-boring bit according to claim 1, wherein the contact point or region of each cutter is defined by a row of heel cutting elements on the cutter.

4. The earth-boring bit according to claim 1, wherein at least a portion of each of the stabilizing surfaces is formed of a hard metal.

5. The earth-boring bit according to claim 4, wherein the hard metal is selected from a class of materials consisting of tungsten, chromium, molybdenum, niobium, tantalum, titanium and vanadium carbide.

6. The earth-boring bit according to claim 5, wherein the hard metals are selected from the class of tungsten, chromium, molybdenum, niobium, tantalum, titanium and vanadium carbide and the super-hard material is selected from the class of natural diamond, synthetic diamond and cubic boron nitride.

7. The earth-boring bit according to claim 1, wherein each of the stabilizing surfaces includes a super-hard material.

8. The earth-boring bit according to claim 7, wherein the super-hard material is selected from a class of material consisting of natural diamond, synthetic diamond and cubic boron nitride.

9. The earth-boring bit according to claim 1, where at least a portion of each of the stabilizing surfaces comprises alternating regions of hard metal and super-hard material.

10. The bit according to claim 1 wherein each of the stabilizing surfaces is approximately midway between two of the contact points or regions.

11. An improved rolling cone rock bit comprising:

a body having a geometric centerline intended as a first rotational axis;

three rotatable cutters supported on the body, each adapted to rotate about a second set of rotational axis, offset from the centerline of the bit;

each of the cutters including generally conical surfaces, at least one of which contains an outermost, circumferential row of heel teeth that dislodge cuttings from a borehole bottom and form a corner with the borehole wall with successive contact points defined by the outer edges of successive heel teeth while rotating into, and prescribing, the corner as it spirals downwardly during drilling; and three stabilizing pads, each of the pads extending radially from the body and having a surface containing a wear resistant material to engage the wall of the borehole above and approximately midway between the contact points of two of the cutters to confine the body to rotation about the first axis of rotation.

12. The invention defined by claim 11 wherein at least a portion of the surfaces of the pads are formed of a hard metal.

13. The invention defined by claim 12 wherein the pads include a super-hard material.

14. The invention defined by claim 13 wherein the super-hard material is selected from a class of material consisting of natural diamond, synthetic diamond and cubic boron nitride.

15. The invention defined by claim 12 wherein the hard metal is selected from a class of materials consisting of tungsten, chromium, molybdenum, niobium, tantalum, titanium and vanadium carbide.

16. The invention defined by claim 11 wherein at least a portion of the pads comprises alternating regions of hard metal and super-hard materials.

17. The invention defined by claim 16 where the hard metal is selected from the class of tungsten, chromium, molybdenum, niobium, tantalum, titanium and vanadium carbide and the super-hard material is selected from the class of natural diamond, synthetic diamond and cubic boron nitride.

18. The bit according to claim 11 wherein the contact points are ahead of the intersection of the cutter axis with the borehole wall in the direction of rotation.

19. The bit according to claim 11 wherein said surfaces of the pads are smooth so as to engage the borehole wall without cutting.

20. The bit according to claim 11 wherein each of the pads is diametrically across from one of the contact points of one of the cutters.

21. An earth-boring bit comprising:

a bit body having an intended rotational axis;

three bearing shafts depending inwardly and downwardly from the bit body;

a cutter mounted for rotation on each bearing shaft, each cutter having plurality of cutting elements arranged in circumferential rows including a heel row;

a region of contact between each cutter and the wall of the borehole being drilled, the region of contact at least partially defined by engagement between the heel row of cutting elements and the wall of the borehole; and a plurality of stabilizing surfaces on the body, each of the stabilizing surfaces containing a wear-resistant material to engage the wall of the borehole above and generally diametrically across from the region of contact of each of the cutters to confine the bit body to rotation about the rotational axis, the portions of the stabilizing surfaces that engage the wall being smooth and non-aggressive.

22. The earth-boring bit according to claim 21, wherein at least a portion of each of the stabilizing surfaces is formed of a hard metal.

23. The earth-boring bit according to claim 22, wherein the hard metal is selected from a class of materials consisting of tungsten, chromium, molybdenum, niobium, tantalum, titanium and vanadium carbide.

24. The earth-boring bit according to claim 21, wherein each of the stabilizing surfaces includes a super-hard material.

25. The earth-boring bit according to claim 24, wherein the super-hard material is selected from a class of materials consisting of natural diamond, synthetic diamond and cubic boron nitride.

26. The earth-boring bit according to claim 21, wherein at least a portion of each of the stabilizing surfaces comprises alternating regions of hard metal and super-hard material.

27. The earth-boring bit according to claim 26, wherein the hard metals are selected from the class of materials consisting of tungsten, chromium, molybdenum, niobium, tantalum, titanium and vanadium carbide and the super-hard material is selected from the class of natural diamond, synthetic diamond and cubic boron nitride.

* * * * *